US007762750B2

(12) United States Patent
Sprague et al.

(10) Patent No.: US 7,762,750 B2
(45) Date of Patent: Jul. 27, 2010

(54) REMOVABLE RACK MOUNT FRAME

(75) Inventors: David Sprague, Northfield, MA (US); Theodore Lynds, Cummington, MA (US); Brian Leduc, Belchertown, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 796 days.

(21) Appl. No.: 11/424,636

(22) Filed: Jun. 16, 2006

(65) Prior Publication Data

US 2006/0289470 A1 Dec. 28, 2006

Related U.S. Application Data

(60) Provisional application No. 60/692,366, filed on Jun. 20, 2005.

(51) Int. Cl.
*B60P 7/00* (2006.01)

(52) U.S. Cl. ..... 410/84; 312/334.1

(58) Field of Classification Search ..... 410/32, 410/87, 88, 91, 81, 84, 151; 312/283, 286, 312/334.1, 334.36; 211/162, 126.7, 79; 220/23.87, 220/23.89, 23.88

See application file for complete search history.

(56) References Cited

U.S. PATENT DOCUMENTS 3,110,506 A * 11/1963 O'Brien ..... 410/151
4,460,222 A 7/1984 Larking
4,545,710 A * 10/1985 Hepp ..... 410/32
4,974,377 A 12/1990 Dominitz et al.
6,082,844 A * 7/2000 Hausler et al.
6,217,359 B1 4/2001 Chang
6,609,466 B2 8/2003 Salmanson et al.

FOREIGN PATENT DOCUMENTS

| | | |
|---|---|---|
| DE | 2056775 | 5/1972 |
| DE | 2647663 | 4/1978 |
| EP | 0 138 576 A3 | 4/1985 |
| EP | 0138576 | 4/1985 |
| FR | 2122790 | 9/1972 |
| GB | 2021072 | 11/1979 |

* cited by examiner

*Primary Examiner*—Stephen Gordon
(74) *Attorney, Agent, or Firm*—McCormick, Paulding & Huber LLP

(57) ABSTRACT

A removable rack mount frame for securing goods within a container while permitting unfettered access to the goods includes forming an inner frame assembly and an outer frame assembly. Nesting the inner frame assembly within the outer frame assembly in a manner that permits the inner frame assembly to slide relative to the outer frame assembly. A biasing mechanism is provided to one of the inner frame assembly or the outer frame assembly so as to arrest the inner frame assembly in a predetermined orientation relative to the outer frame assembly. Selectively operating the biasing mechanism to permit the inner frame assembly to be moved from the predetermined orientation.

8 Claims, 5 Drawing Sheets

REMOVABLE RACK MOUNT FRAME

CROSS REFERENCE TO RELATED APPLICATIONS

This application claims the benefit of U.S. Provisional Application Ser. No. 60/563,159, filed on Jun. 20, 2005, and herein incorporated by reference in its entirety.

FIELD OF THE INVENTION

This invention relates, in general, to a removable rack mount frame, and deals more particularly with a removable rack mount frame having increased operability and functionality.

BACKGROUND OF THE INVENTION

Cases, containers, and the like, are typically utilized for the transportation of goods and equipment. As is known, these cases often experience rough handling conditions, as well as transit-related impacts and blows.

Of great concern, therefore, is the safety and protection of the goods or equipment stored within these cases. There has been proposed differing container systems that strive to protect the stored goods or equipment via the introduction of internal protective mechanisms, such as belts, straps, cushioning foam, bubble-wrap, or the like.

While protecting the transported goods and equipment to a certain degree, these known protective mechanisms often fail to protect their cargo during extreme impacts. Moreover, some of the known protective mechanisms are complex, and so provide a host of logistical and ergonomic difficulties when a user attempts to position the cargo within the case.

With the forgoing problems and concerns in mind, it is the general object of the present invention to provide a removable rack mount frame that not only protects the secured cargo against extreme impacts, but also facilitates an ease of packing and removability not heretofore known in the art.

SUMMARY OF THE INVENTION

It is an object of the present invention to provide a removable rack mount frame.

It is another object of the present invention to provide a removable rack mount frame for a case, that includes nested frame assemblies.

It is another object of the present invention to provide a removable rack mount frame for a case, whereby the removable rack mount frame enables the removal of the inner nested frame assembly from the outer frame assembly.

It is another object of the present invention to provide a removable rack mount frame for a case that includes nested frame assemblies which may be selectively disposed at differing structural orientations to one another.

It is yet another object of the present invention to provide a removable rack mount frame that utilizes locking pins to selective arrange the inner nested frame at a predetermined distance from the outer nested frame.

It is another object of the present invention to provide a removable rack mount frame that includes several shock absorbing pads mounted between the outer nested frame assembly and the wall of the case.

It is therefore a general object of the present invention to propose a removable rack mount frame for securing goods within a container while permitting unfettered access to the goods, by forming an inner frame assembly and an outer frame assembly. Nesting the inner frame assembly within the outer frame assembly in a manner that permits the inner frame assembly to slide relative to the outer frame assembly. A biasing mechanism is provided to one of the inner frame assembly or the outer frame assembly so as to arrest the inner frame assembly in a predetermined orientation relative to the outer frame assembly. The selective operation of the biasing mechanism permits the inner frame assembly to be moved from the predetermined orientation.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
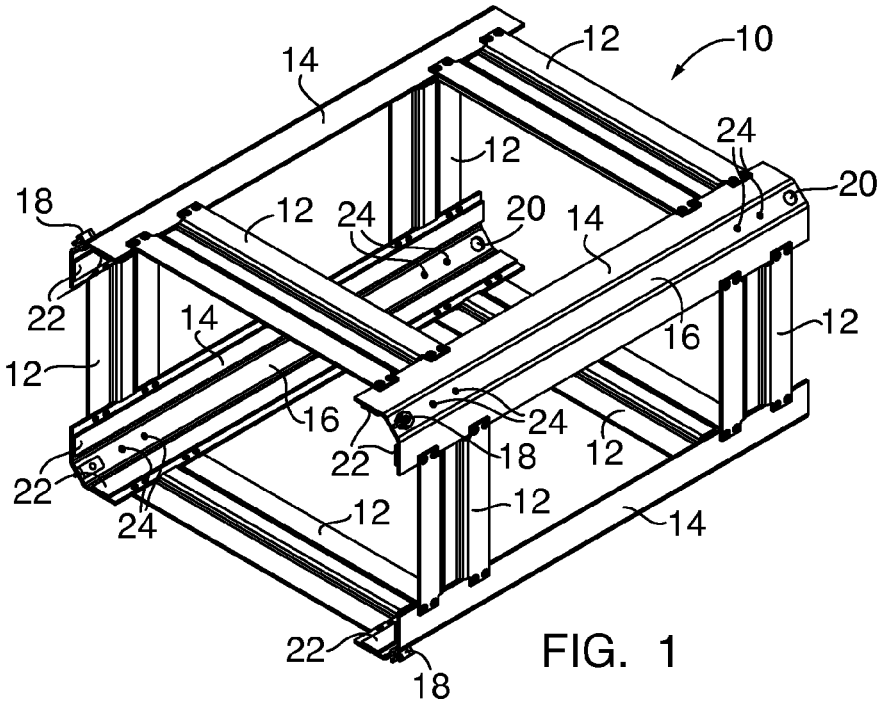
FIG. 1 is a perspective view of the outer frame assembly of a removable rack mount frame, according to one embodiment of the present invention.
Figure 2:
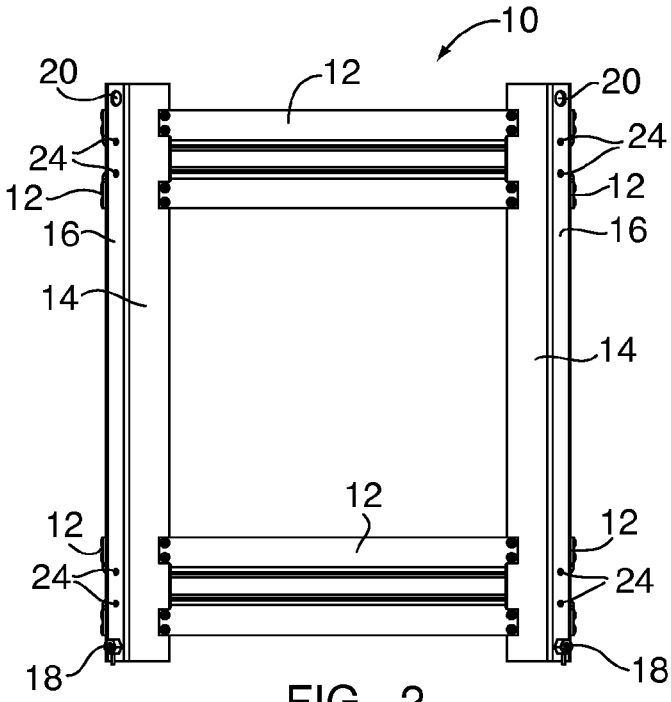
FIG. 2 is a top view of the outer frame assembly of a removable rack mount frame shown in FIG. 1.

FIG. 1 illustrates multiple views of the outer nested frame 10 of a removable rack mount frame, according to one embodiment of the present invention. FIG. 2 is a top view of the outer nested frame 10 of FIG. 1. The outer nested frame 10 shown in FIG. 1 is preferably formed in the shape of a rectangular, or cube-like, assembly in order to be accommodated within a similarly-shaped case or container. It will, of course, be readily appreciated that the case could be of any shape or size, and that the outer nested frame 10 could likewise be of any particular geometrical configuration, without departing from the broader aspects of the present invention.

Returning to FIG. 1, it can be seen that the outer nested frame 10 includes a series of horizontal and vertical support members 12 which, together with a plurality of edge members 14, form the outer structural configuration of the removable rack mount frame of the present invention. The support members 12 and the edge members 14 may be welded, riveted or otherwise fixedly bonded to one another in any known manner.

As also shown in FIG. 1, the edge members 14 are preferably comprised to have three distinct and elongated planes, including a center chamfered plane 16. Each of the chamfered planes 16 themselves support a spring biased locking pin 18 at the distal end thereof. As will become clear later, the spring biased locking pins 18 operate to selectively position an inner nested frame assembly at a predetermined structural orientation to the outer nested frame assembly 10. As is also illustrated in FIG. 1, the spring biased locking pins 18 may be selectively mounted to either distal end of the chamfered plane 16 via mounting holes 20.

While the locking pins 18 have been described as being preferably spring biased, the present invention is not limited in this regard as other biasing means may be alternatively utilized, including non-actively biased locking means, without departing from the broader aspects of the present invention.

Figure 3:
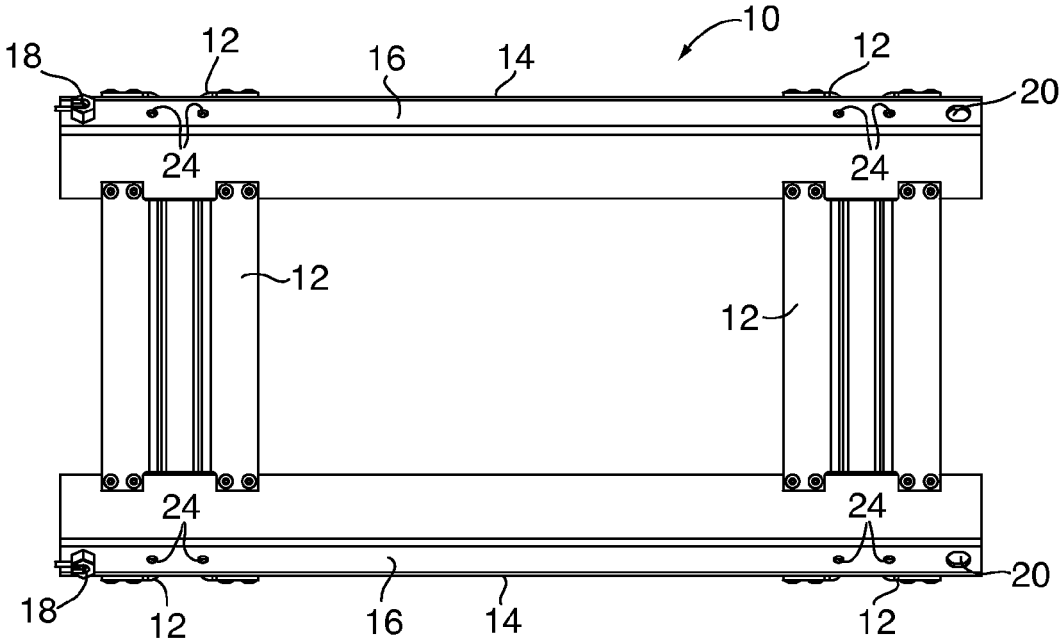
FIG. 3 is a side view of the outer frame assembly of FIG. 1.
Figure 4:
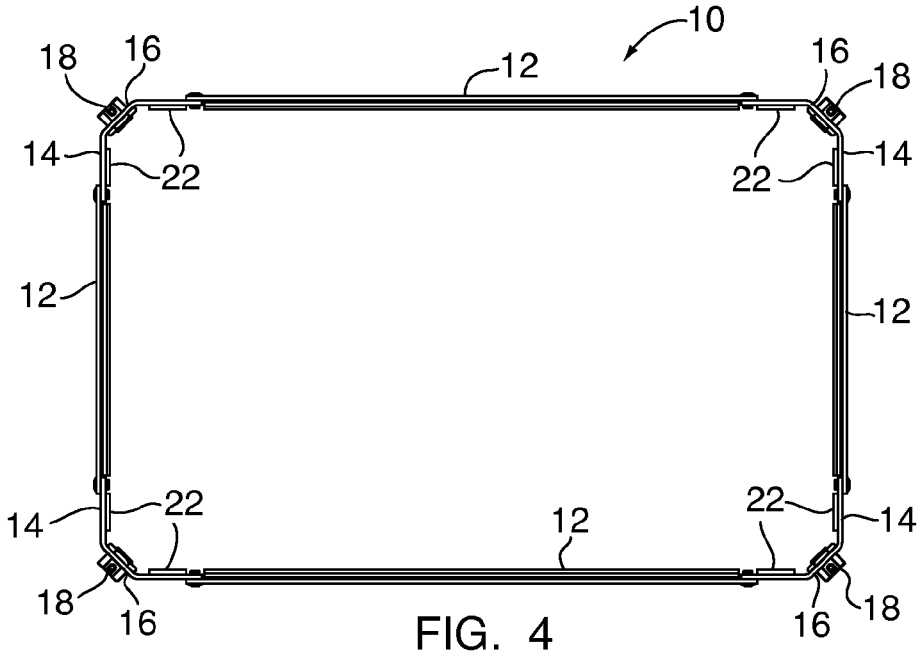
FIG. 4 is an end view of the outer frame assembly of FIG. 1.

FIG. 3 illustrates a side view of the outer nested frame assembly 10, while FIG. 4 illustrates an end view of the same. As best seen in FIGS. 1 and 4, the outer nested frame 10 also includes a plurality of wear pads 22 fixedly disposed on the opposing elongated planar sides of the edge members 14. As will become clear later, the wear pads 22 serve to facilitate the smooth, sliding movement of the inner nested frame assembly into, and out of, the outer nested frame assembly 10.

The wear pads 22 are shown in FIG. 1 as being elongated strips extending along the interior surface of the edge members 14, and are preferably formed from any resilient and semi-frictionless material, inclusive of metallic material having a suitable plastic or polymer coating.

Still further, one or more shock absorbing bushings 42 (shown in FIG. 9) may also be mounted to the chamfered plane 16 (or other, exterior portions of the edge members 14) via apertures 24. In the preferred embodiment of the present invention, the shock absorbing bushings 42 are disposed between the outer nested frame assembly 10 and the walls of the container 40 (also shown in FIG. 9), within which the removable rack mount frame 25 is secured.

Figure 5:
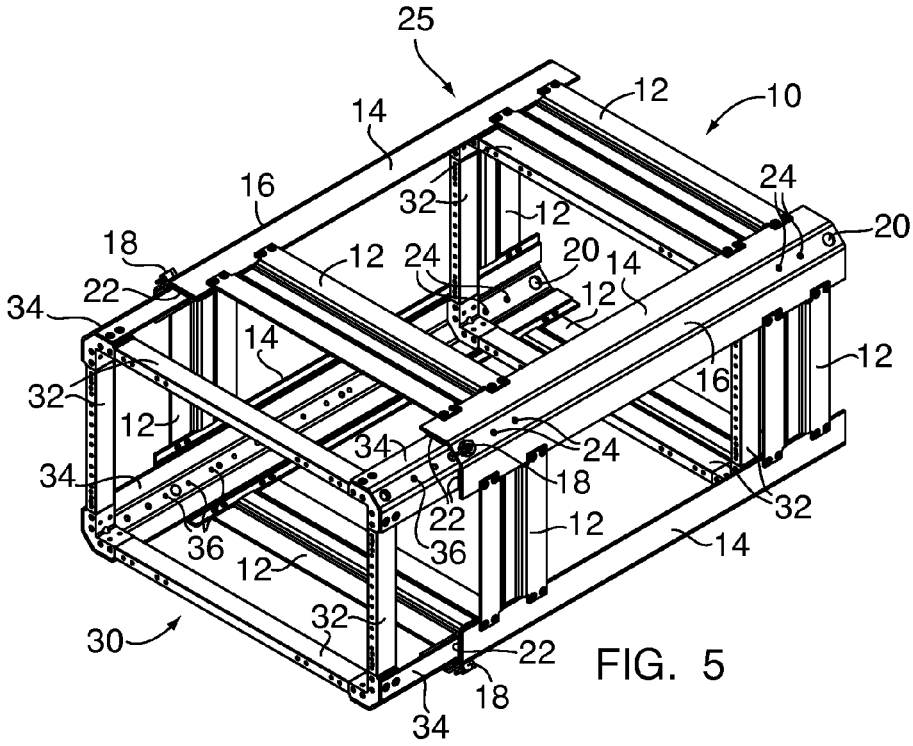
FIG. 5 is a perspective view of the inner frame assembly being nested within the outer frame assembly of the removable rack mount frame, in accordance with one embodiment of the present invention.
Figure 6:
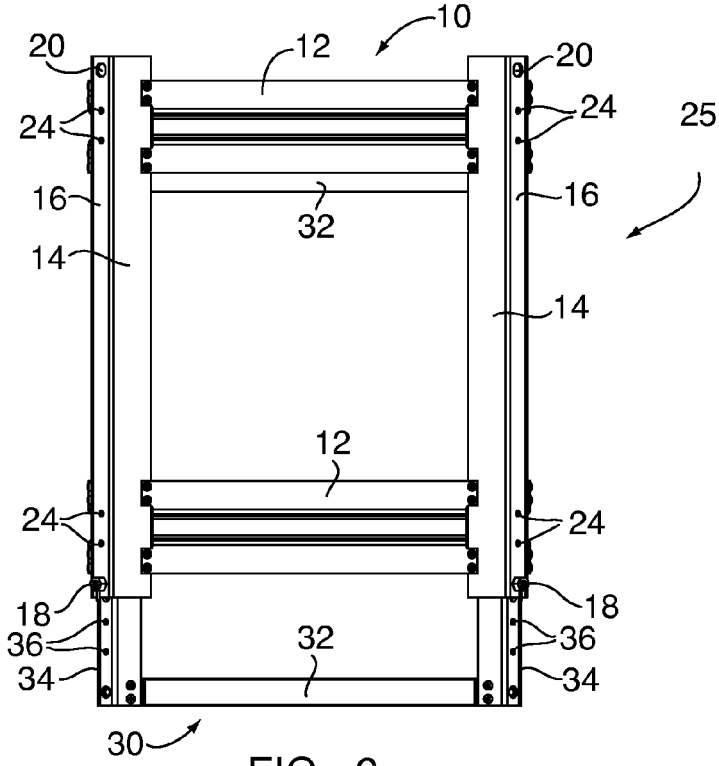
FIG. 6 is a top view of the nested inner and outer frames shown in FIG. 5.

Turning now to FIGS. 5-8, the removable rack mount frame 25 of the present invention is illustrated in its nested form. FIG. 5 illustrates a perspective view of the nested removable rack mount frame 25, while FIG. 6 illustrates a top view of the same. As shown in FIGS. 5 and 6, the outer frame assembly 10 accommodates an inner nested frame assembly 30. The inner nested frame assembly 30 itself includes substantially the same structural configuration as does the outer nested frame assembly 10, including defining a plurality of horizontal and vertical support members 32 and edge members 34.

Figure 7:
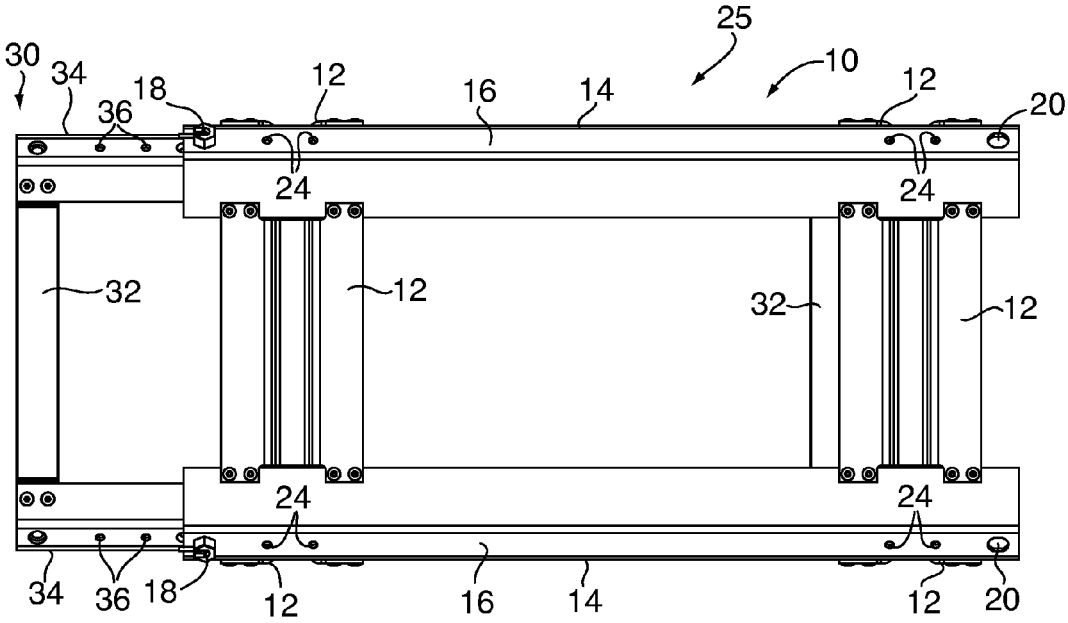
FIG. 7 is a side view of the nested inner and outer frames shown in FIG. 5.

Similar to the edge members 14, the edge members 34 are also comprised of three distinct and elongated planes, including a center chamfered plane that slides in intimate nesting contact with the chamfered plane 16. A series of positional apertures 36 are formed in the elongated chamfered plane of the inner nested frame assembly 30, and serve to selectively accommodate the locking pins 18. In this manner, and as will be appreciated, the inner nested frame assembly 30 may be selectively secured at a predetermined extended position (as shown in FIGS. 5, 6 and 7) in relation to the outer nested frame assembly 10, via the interaction between the locking pins 18 and the positional apertures 36.

As will be appreciated, the pins 18 are biased to extend inwardly of the outer frame 10, and therefore may be manually retracted to permit the inner, nested frame 30 to be extended therefrom.

It is therefore an important aspect of the present invention that the inner nested frame assembly 30 may be pulled outwardly from the outer nested frame assembly 10 by a predetermined amount, and secured in this extended position via the selective application of the locking pins 18 into one of the positional apertures 36 formed on the edge members 34 of the inner nested frame assembly 30.

Figure 8:
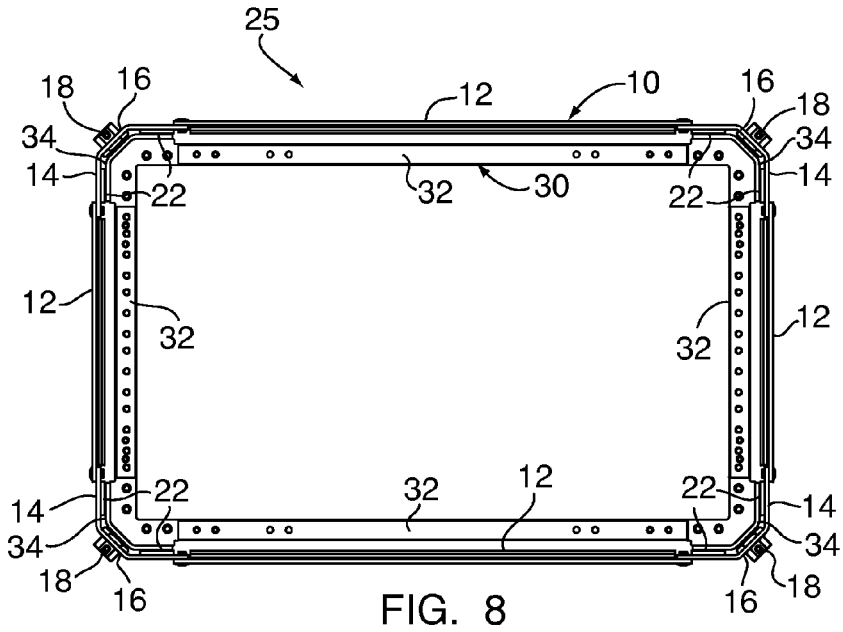
FIG. 8 is an end view of the nested inner and outer frames shown in FIG. 5.

In practical application, the outer frame assembly will be mounted within a container, while the inner, nested frame assembly 30 will be removably mounted within the outer frame assembly 10. Thus, the present invention permits the inner nested frame assembly 30 to be pulled from the container housing the removable rack mount frame 25 so as to more easily permit a user to load or unload cargo from the container. FIG. 7 illustrates a side view of the extended inner frame 30, while FIG. 8 illustrates an end view of the nested inner and outer frames 30/10.

It is another important aspect of the present invention that the inner nested frame assembly 30 may be removed completely from nested interaction with the outer nested frame assembly 10 by the selective decoupling of the locking pins 18 from their berths within the positional apertures 36. Thus, the removable rack mount frame 25 enables the complete removal of the inner nested frame assembly 30, thereby permitting the user the ability to pack, unpack or otherwise manipulate, fix or test the cargo within the inner nested frame assembly 30 without the interference caused by the container or outer nested frame assembly 10.

It is still yet another important aspect of the present invention that the locking pins 18 not only selectively position the inner nested frame assembly 30 at a predetermined distance from, or in relation to, the outer nested frame assembly 10, but also that the locking pins 18 releasably secure the inner nested frame assembly 30 to the outer nested frame assembly 10 during transport of the container. Thus, with the outer nested frame assembly 10 being fixed to the walls of the container, the locking pins 18 secure the inner nested frame assembly 30 from possibly destructive movement when the container is dropped, or suffers some other type of impact or incident force.

Figure 9:
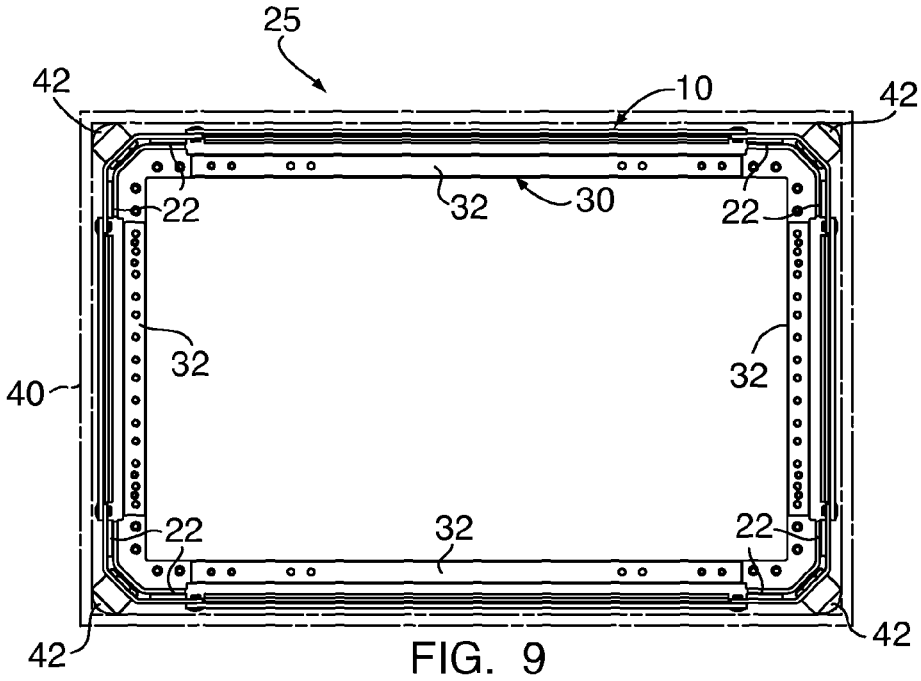
FIG. 9 is an end view of the removable rack mount frame being mounted within a container.

FIG. 9 illustrates an end view of the removable rack mount frame 25, including a container 40 within which the outer frame 10 of the removable rack mount frame 25 is secured. It will be readily appreciated that the outer frame 10 may be selectively secured to the interior of the container 40 by any suitable means, such as by utilizing rivets, threaded fasteners, adhesive, or the like, without departing from the broader aspects of the present invention. Moreover, although the shock-absorbing bushings 42 have been shown as extending from the chamfered planes 16 in FIG. 9, the bushings 42 may alternatively (or, in addition to) be mounted to other portions of the edge members 14 of the inner nested frame 30.

It should be readily appreciated that the inner and outer frame assemblies, 30 and 10 respectively, need not be structurally formed in accordance with FIGS. 1-9. That is, the present invention encompasses all structural configurations in which there are nested frame assemblies, and whereby the inner nested frame assembly is selectively slidable and removable in relation to the outer frame assembly that is itself fixed to the walls of a container. Moreover, by providing selectively actuated spring biased locking pins 18, the present invention permits the selective and complete removal of the inner nested frame assembly 30 from the container and the outer nested frame assembly 10.

The present invention finds particular usefulness in the transportation of complex, sensitive and/or electrical equipment. That is, by enabling the removal of the inner nested frame assembly 30 from the outer nested frame assembly 10, and thereby from the container within which the outer nested frame assembly 10 is mounted, a user may have complete and unfettered access to the compartment defined by the inner nested frame assembly 30. In certain situations, such as the packing and transportation of sensitive military electrical equipment, the ability to have a complete, 360° access to the compartment defined by the inner nested frame assembly 30, the removable rack mount frame 25 of the present invention provides a level of access not heretofore known in the art.

Indeed, in those applications where interconnected electrical components are installed within a container system, the present invention permits a user to selectively remove the inner nested frame assembly 30 from the container so as to perform the electrical connections between the electrical components. As mentioned previously, known container systems demand that the packing and electrical connections of any cargo take place within the confines of the container itself. Thus, the removable rack mount frame 25 greatly assists in the speed of loading cargo within a container, as well as providing greater shock absorption for the cargo itself.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A removable rack mount frame for use within a shipping container, said removable rack mount frame comprising:

an outer frame assembly secured to an interior of said container, said outer frame assembly including outer edge members interconnected by outer support members to bound an outer volume;

an inner frame assembly nested within the outer volume bounded by said outer frame assembly and releasably rigidly secured to said outer frame assembly, said inner frame assembly including inner edge members interconnected by inner support members to bound an inner volume for receiving cargo; and a biasing means operatively attached to one of said inner and said outer frame assemblies, wherein said biasing means is operable to release said inner frame assembly from said outer frame assembly for sliding motion of the inner edge members along the outer edge members, and to selectively arrest said inner frame assembly at a plurality of predetermined orientations with respect to said outer frame assembly, and wherein said inner frame assembly extends out of said container when arrested by said biasing means in at least one of said plurality of predetermined orientations.

2. The removable rack mount frame according to claim 1, further comprising:

pads affixed to said outer frame assembly, said pads providing a base upon which said inner frame assembly is slidably moved.

3. The removable rack mount frame according to claim 2, wherein:

said pads are affixed about an inner periphery of said outer frame assembly.

4. The removable rack mount frame according to claim 1, further comprising:

a mounting hole formed in one of said inner frame assembly and said outer frame assembly; and a positioning hole formed in the other of said inner frame assembly and said outer frame assembly, wherein said biasing means is secured in said mounting hole for selective engagement with said positioning hole.

5. The removable rack mount frame according to claim 4, wherein:

said biasing means is a spring biased pin.

6. The removable rack mount frame according to claim 1, further comprising:

a mounting hole formed in one of said inner frame assembly and said outer frame assembly; and a plurality of positioning holes formed in the other of said inner frame assembly and said outer frame assembly, wherein said biasing means is secured in said mounting hole for selective engagement with one of said plurality of positioning holes.

7. The removable rack mount frame according to claim 6, wherein:

said plurality of positioning holes correspond to said plurality of predetermined orientations.

8. The removable rack mount frame according to claim 1, further comprising:

shock absorption means disposed between an outer periphery of said outer frame assembly and said interior of said container.

* * * * *